US006351918B1

(12) United States Patent
Westra et al.

(10) Patent No.: US 6,351,918 B1
(45) Date of Patent: Mar. 5, 2002

(54) INSULATED CONCRETE WALL

(76) Inventors: Albert P. Westra; Gregory A. Westra, both of 19548 Gunpowder Rd., Millers, MD (US) 21107

( * ) Notice: Subject to any disclaimer, the term of this patent is extended or adjusted under 35 U.S.C. 154(b) by 0 days.

(21) Appl. No.: 09/243,382

(22) Filed: Feb. 1, 1999

Related U.S. Application Data

(63) Continuation-in-part of application No. 09/065,285, filed on Apr. 23, 1998, now Pat. No. 6,079,176.
(60) Provisional application No. 60/060,364, filed on Sep. 29, 1997.

(51) Int. Cl.[7] ..... E04G 17/06
(52) U.S. Cl. ..... 52/404.2; 52/309.11; 52/309.12; 52/309.17; 52/699; 249/40; 249/46; 249/214; 249/216
(58) Field of Search ..... 52/698, 699, 700, 52/701, 703, 707, 712, 713, 714, 715, 404.2, 404.3, 404.5, 407.2, 407.4, 378, 379, 309.8, 309.11, 309.12, 309.17; 249/190, 191, 207, 213, 214, 216, 218, 15, 38, 40, 41, 43, 46

(56) References Cited

U.S. PATENT DOCUMENTS

| | | | | | |
|---|---|---|---|---|---|
| 1,702,671 | A | * | 2/1929 | Toogood | 249/191 X |
| 3,137,909 | A | * | 6/1964 | Bonin et al. | 249/191 |
| 3,362,678 | A | * | 1/1968 | Bowden | 249/214 |
| 3,438,161 | A | * | 4/1969 | Koch | 52/309.12 X |
| 3,985,329 | A | * | 10/1976 | Liedgens | 249/216 X |
| 4,149,349 | A | * | 4/1979 | Nilsen et al. | 52/712 X |
| 4,348,847 | A | * | 9/1982 | Jukes | 52/309.11 X |
| 4,541,211 | A | * | 9/1985 | Garrett | 52/309.12 X |
| 4,702,053 | A | * | 10/1987 | Hibbard | 52/309.7 |
| 5,265,836 | A | * | 11/1993 | Dale | 249/191 |
| 5,671,574 | A | * | 9/1997 | Long | 52/309.11 |
| 5,987,830 | A | * | 11/1999 | Worley | 52/309.11 |
| 6,079,176 | A | * | 6/2000 | Westra et al. | 52/404.2 |

FOREIGN PATENT DOCUMENTS

| | | | | |
|---|---|---|---|---|
| CH | 561345 | * | 4/1975 | 249/213 |

* cited by examiner

*Primary Examiner*—Laura A. Callo
(74) *Attorney, Agent, or Firm*—Bartlett & Sherer; Ronald B. Sherer

(57) ABSTRACT

A system is disclosed for securing a layer of insulation in place between two spaced apart wall forms while concrete is poured on both sides of the insulation layer.

5 Claims, 5 Drawing Sheets

INSULATED CONCRETE WALL

RELATED APPLICATION

This Application is a Continuation-In-Part of application Ser. No. 09/065,285 filed Apr. 23, 1998 now U.S. Pat. No. 6,079,176 which is based upon Provisional Application Ser. No. 06/060,364 filed Sep. 29, 1997, the priority dates of both Applications being hereby claimed and being hereby incorporated by reference.

FIELD OF THE INVENTION

The present invention relates to poured concrete walls and, more particularly, to poured concrete walls including a layer of thermal insulation for reducing heat transfer in which the insulation layer is secured to the concrete wall at the time of pouring the concrete.

BACKGROUND

Concrete walls are commonly formed by pouring concrete between inner and outer forms and, after hardening, insulation materials for reducing the thermal R valve may be added to the concrete walls. In order to do so, frame members may be applied to the concrete wall, such as by using pneumatic guns and concrete nails, and then the insulating material may be secured to the frame members. Alternatively, the insulation may be secured to the concrete wall by concrete nails. Such multi-step assembly procedures are both time consuming and costly. Thus, there has long been a need for a system and a method whereby poured concrete walls may be formed and insulated at the same time in one step.

SUMMARY

The present invention provides an apparatus and method for securing an insulation layer in place while the concrete is poured between conventional forms, and for continuing to secure the insulation layer to the poured concrete wall after the forms have been removed.

DETAILED DESCRIPTION

Figure 1:
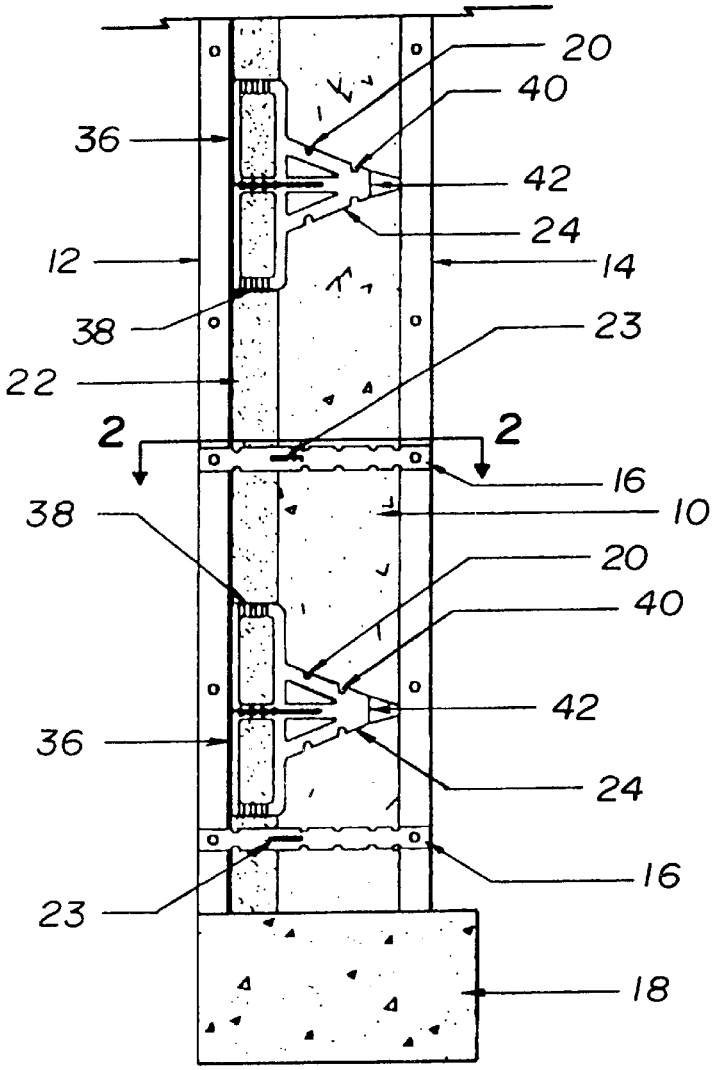
FIG. 1 is a sectional view of a poured concrete wall with a thermal insulation layer secured thereto.
Figure 3:
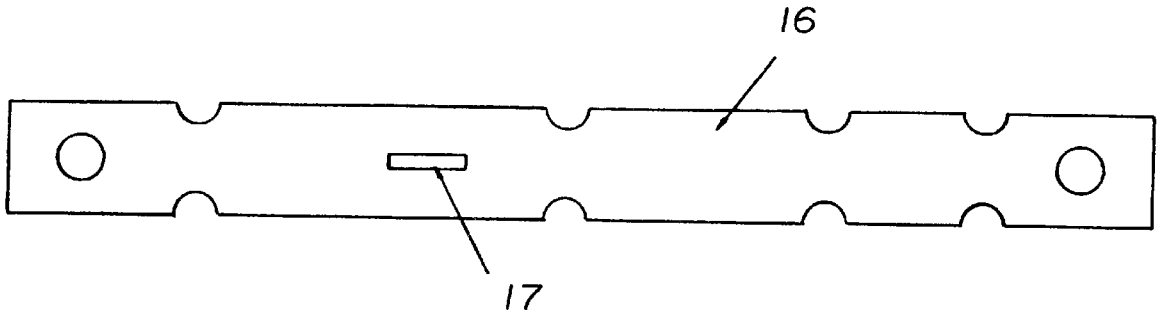
FIG. 3 is an enlarged side-elevational view of one tie strip.

Referring first to FIG. 1, numeral 10 designates a concrete wall which has been poured between first and second conventional forms 12 and 14. Forms 12, 14 are held together by metal strips or ties 16 as in conventional practice. However, as shown most clearly in FIG. 3, each of ties 16 includes a non-conventional slot 17 for a purpose hereinafter described. Numeral 18 represents a conventional footing for supporting the wall, and numeral 20 represents a plurality of conventional reinforcing bars ("rebar") which extend horizontally through the poured concrete to add strength to the wall.

The structure described thus far is typical of the manner of forming poured concrete walls. After the concrete hardens, forms 12 and 14 are removed and the concrete wall is complete. If insulation is to be added, frame members (not shown) must be secured to the wall, or sheets or rolls of insulation must be secured by pneumatic nailing guns. As previously stated, this double-step procedure is both time consuming and costly.

Figure 2:
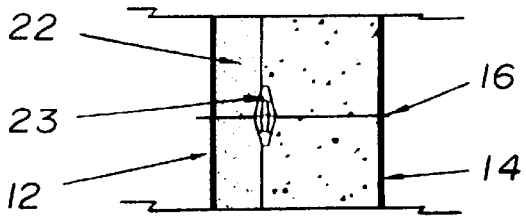
FIG. 2 is a cross-sectional view taken along line 2—2 of FIG. 1.
Figure 4:
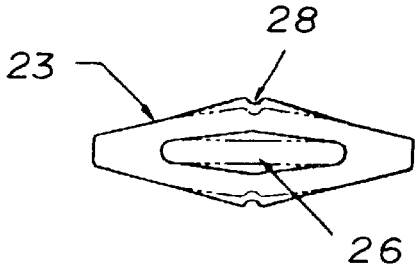
FIG. 4 is a top plan view of a wedge which is inserted into the tie strip.

In the present invention, layers or panels of insulation 22 are secured in place before the concrete is poured between forms 12, 14. The means for securing the insulation in place during the pouring of the concrete comprise clips or wedges 23 and anchors or connectors 24. Clips or wedges 23, hereinafter wedges, are shown in detail in FIGS. 2 and 4. Each wedge comprises a molded piece of plastic, such as polypropylene, which is in the form of a double-ended V-shape with an open hole 26 in the central region. As such, the wedges are flexible and resilient so that they may be squeezed together in the center portion and inserted into slots 17 of ties 16. Upon insertion, the center portions of the wedges expand such that grooves 28 lock in ties 16 and the wedges extend horizontally. As shown most clearly in FIG. 2, approximately one-half of each wedge becomes embedded in the insulation panel, and the other half becomes embedded in the poured concrete. As a result, the insulation panels become locked to fixed ties 16 so that the lightweight panels cannot "float" upwardly when the concrete is poured.

In addition to ties 16 and wedges 23, the present invention provides anchors or connectors 24 as shown in FIGS. 1 and 5–7. Preferably, connector elements 24 are in the form of a web portion 32 having openings 34 so that the poured concrete passes through and fills the openings as shown in FIG. 1. Thus, as the concrete hardens, connectors 24 become bound and locked in the concrete.

As further shown most clearly in FIGS. 1 and 5–7, each connector 24 includes an enlarged head portion 36 which extends laterally and vertically at a right angle relative to the web portion. Thus, when the web portion of each connector passes through a slot 38 in the insulation panel as shown in FIGS. 1 and 8, the panel is retained by head portion 36 while the web portion is retained in and by the concrete. In the preferred embodiment, it will be understood that the area of the insulation surrounding slot 38 may be recessed or counter-sunk such that the exposed surface of the connector head is flush with the surface of the insulation. However, the thickness of the head portion is only in the order of ¼ inch or less such that counter-sinking is not necessary.

Figure 5:
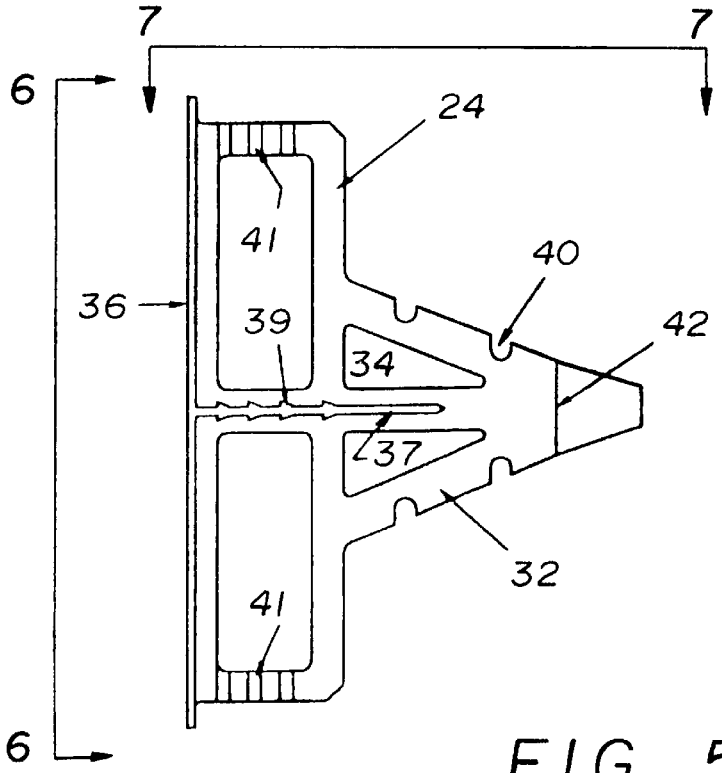
FIG. 5 is an enlarged, side elevational view of one form of support element for securing the insulation layer to the concrete wall prior to, during, and after the concrete is poured.
Figure 6:
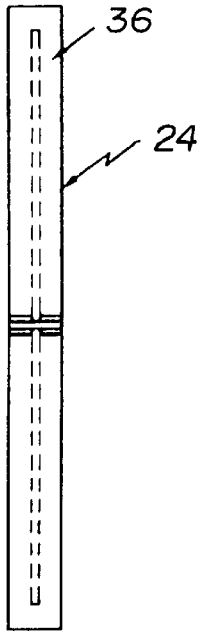
FIG. 6 is a front plan view of the support element taken along line 6—6 of FIG. 5.
Figure 7:
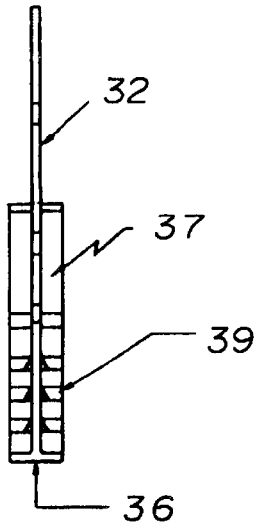
FIG. 7 is a top plan view of the support element taken along line 7—7 of FIG. 5.
Figure 8:
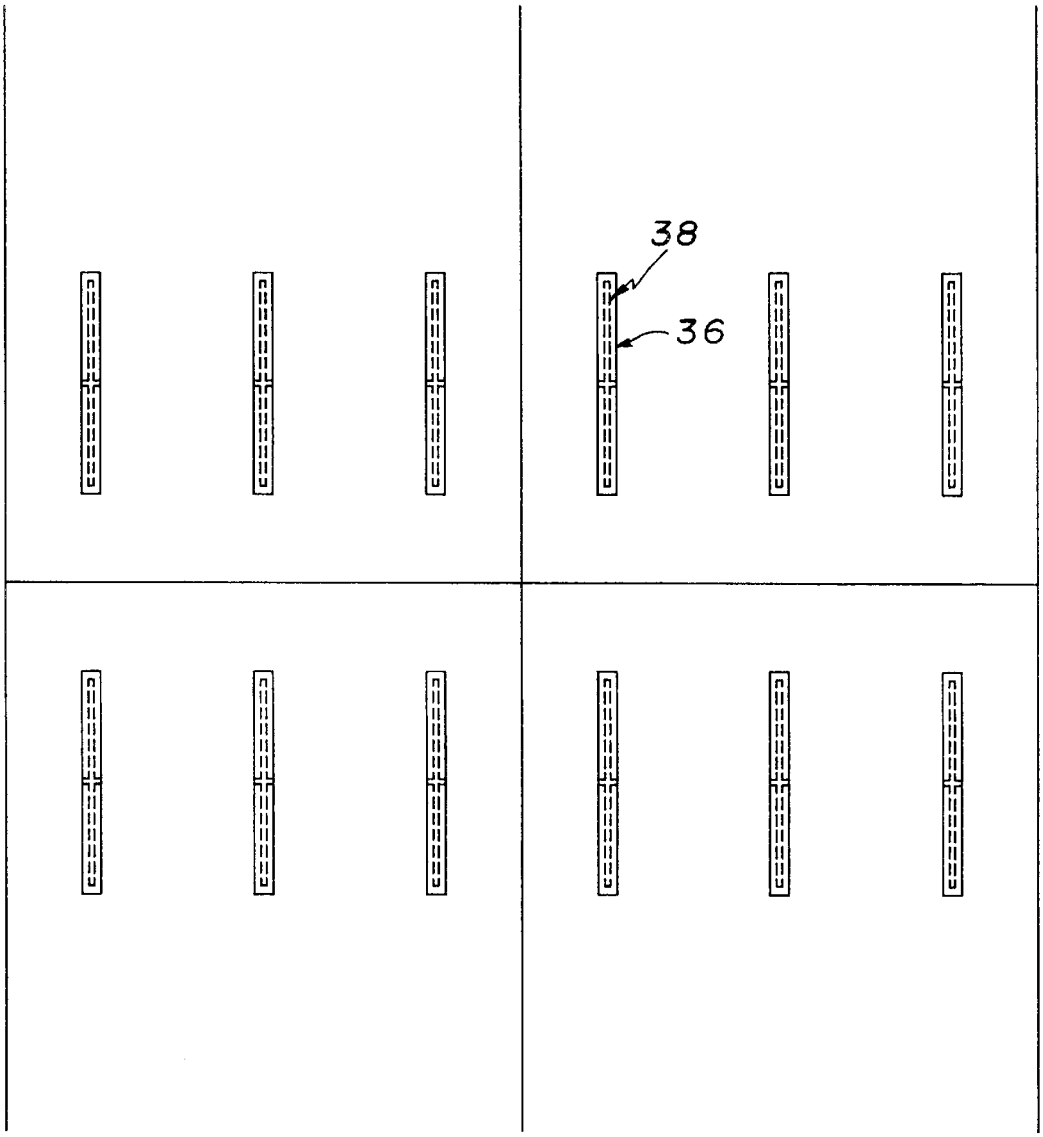
FIG. 8 is an elevational view of a plurality of insulation panels secured to the concrete wall by a plurality of support elements.

Also in the preferred embodiment, stiffening side bars or ribs 37 may be added as most clearly shown in FIGS. 5 and 7, and the stiffening ribs may be provided with barbs 39 for engaging in insulation layer 22. Also, the upper and lower portions of connectors 24 may be provided with barbs 41 which further engage and hold the insulation panel in place. In addition, in order to accommodate walls of either 6 or 8 inches in thickness, the horizontal length of connectors 24 may be manufactured of a uniform 8 inch length, and with grooves 42 as shown in FIG. 5 near the tip of the connector such that the tip may be easily broken off for 6 inch walls.

In the foregoing description, connectors 24 may be held in place during the concrete pouring by virtue of a tight frictional fit between the web portion 32 and slot 38 of the insulation panel and the frictional engagement of barbs 39 and 41. However, a substantially greater securing of the connectors may be effected by providing one or more notches, grooves or hook portions 40 as shown in FIGS. 1 and 5. These hook portions may be engaged by rebar 20 so as to positively lock connectors 24 in place before, during and after the concrete is poured Connectors 24 may be composed of any rigid material, but they are preferably composed of molded plastic such as for example, polypropylene or polyethylene. Such materials may be easily molded, are of low thermal conductivity and are low cost. Most importantly, they provide an excellent medium for receiving nails, screws, staples or other means through heads 36 for securing the later installation of additive wall materials such as plaster board, paneling or other finishing layers.

Insulation layer 22 may be composed of any commercially available material of low thermal conductivity, but is preferably composed of rigid panels of expanded or extruded polystyrene. In addition to the thermal insulation value of such panels, their inherent properties provide a vapor barrier and their thermal properties are not deteriorated by moisture.

Figure 9:
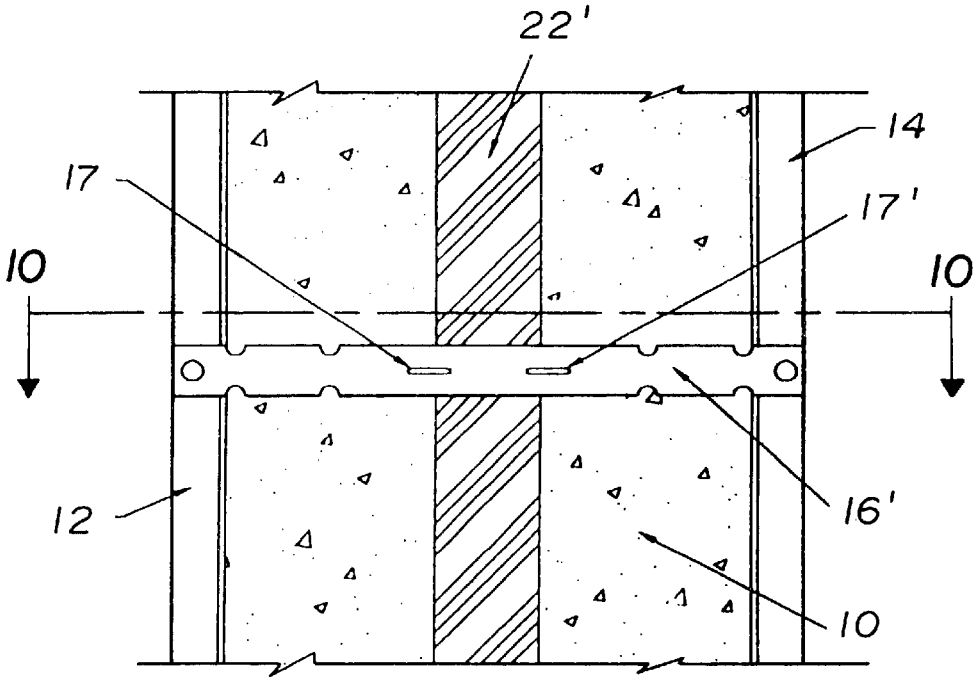
FIG. 9 is a vertical cross-sectional view of a portion of the concrete wall showing an alternative position of the insulation layer.
Figure 10:
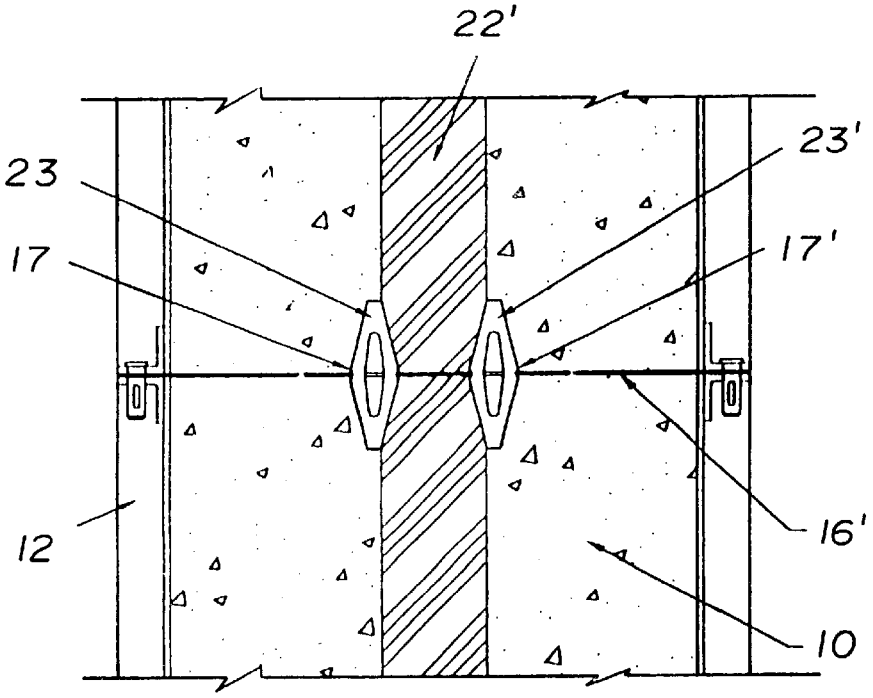
FIG. 10 is a horizontal cross-sectional view of the concrete wall taken along view line 10—10 of FIG. 9.

From the foregoing description of one preferred embodiment it will be apparent that numerous variations in the details will be readily apparent to those skilled in the art. For example, as shown in FIGS. 9–10, insulation layer 22' may be positioned within the interior of concrete wall 10 during the pouring of the concrete. This is of particular benefit in the pouring of concrete walls for commercial-type buildings where no additional finishing of the interior wall is to be provided for after the pouring. In this situation, ties 16' are provided with two slots 17 and 17' and, as shown in FIG. 10, two wedges 23 and 23' are engaged in these slots such that approximately half of each wedge is embedded in foam insulation 22' and the other half becomes embedded in the poured concrete. In any event, wedges 23 and 23', and ties 16' with double slots 17, 17' positively engage the insulation layer 22' and hold it securely, and against floating or otherwise moving upwardly or sideways during the pouring of the concrete. This embodiment produces an insulated wall of the same R value as previously described, but with the insulation layer contained within the concrete wall despite the very substantial buoyant forces which are encountered in the pouring of the concrete.

Accordingly, it will be understood that the foregoing description is purely illustrative of the principles of the invention, and that the invention is not intended to be limited other than as expressly set forth in the claims interpreted under the doctrine of equivalents.

What is claimed is:

1. In a system providing an insulation layer within a poured concrete wall formed between first and second horizontally spaced wall forms, the invention comprising:

(a) a plurality of horizontally extending tie strips having opposite ends, said opposite ends of said tie strips being connected to the horizontally spaced wall forms;

(b) each of said tie strips having first and second apertures positioned along the horizontal length of said tie strip;

(c) said first aperture in each tie strip being spaced a first predetermined distance away from the first wall form and toward the second wall form, and said second aperture in each tie strip being spaced a second predetermined distance away from the second wall form and toward the first wall form;

(d) said first and second predetermined distances being spaced apart from each other by a distance equal to the thickness of the insulation layer; and (e) first and second wedge means extending through said first and second apertures and engaging opposite sides of the insulation layer for holding the insulation layer in place during the pouring of concrete between the wall forms and on opposite sides of the insulation layer.

2. In the system of claim 1, said apertures being rectangular with lengths and widths, and having their lengths extending horizontally; and said wedge means include flexible portions for expanding after insertion through said rectangular apertures.

3. A system for positioning a layer of insulation within a poured concrete wall comprising in combination:

(a) first and second forming walls horizontally spaced apart;

(b) ties extending horizontally between said walls and connected at their ends to said walls;

(c) each of said ties having first and second slots spaced along the length of said tie;

(d) a layer of insulation positioned between said first and second walls and providing space for poured concrete on both sides of said insulation layer between said walls;

(e) said slots being spaced apart by a distance substantially equal to the thickness of said insulation layer; and (f) first and second wedge means extending through said first and second slots, respectively, for engaging said insulation layer on both sides during the pouring of concrete on both sides of said insulation layer between said first and second walls.

4. In the combination of claim 3 wherein said wedge means comprise flexible wedges having ends and mid-portions, and said mid-portions are of greater size than said ends for wedging into said slots.

5. The combination of claim 3 wherein said wedge means are comprised of plastic with flexible portions and grooves for locking into said slots.

* * * * *